US008430694B2

(12) United States Patent
Tung et al.

(10) Patent No.: US 8,430,694 B2
(45) Date of Patent: Apr. 30, 2013

(54) ELECTRICAL CARD CONNECTOR WITH IMPROVED CONTACTS ARRANGEMENT

(75) Inventors: Chang-Hsien Tung, New Taipei (TW); Kuo-Chun Hsu, New Taipei (TW); Hung-Chi Yu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 251 days.

(21) Appl. No.: 13/037,211

(22) Filed: Feb. 28, 2011

(65) Prior Publication Data

US 2012/0083162 A1 Apr. 5, 2012

(51) Int. Cl.
*H01R 24/00* (2011.01)

(52) U.S. Cl.
USPC ..... 439/629

(58) Field of Classification Search ..... 439/629, 439/636, 630, 260, 65, 152, 153, 326, 159, 439/160, 946
See application file for complete search history.

(56) References Cited

U.S. PATENT DOCUMENTS

| | | | | |
|---|---|---|---|---|
| 7,086,906 | B1 * | 8/2006 | Ting | 439/630 |
| 7,628,652 | B2 * | 12/2009 | Ting | 439/630 |
| 7,775,835 | B2 * | 8/2010 | Ting et al. | 439/630 |
| 2002/0132528 | A1 * | 9/2002 | Harasawa et al. | 439/630 |
| 2006/0040561 | A1 * | 2/2006 | Chang et al. | 439/630 |
| 2010/0093200 | A1 * | 4/2010 | Ye et al. | 439/159 |

FOREIGN PATENT DOCUMENTS

| | | |
|---|---|---|
| TW | M320206 | 10/2007 |

* cited by examiner

*Primary Examiner* — Edwin A. Leon
(74) *Attorney, Agent, or Firm* — Wei Te Chung; Ming-Chieh Chang

(57) ABSTRACT

An electrical card connector (100) for receiving a card (7) with conductive traces (711) formed on a top side thereof includes a first insulative housing (1) having a base portion (11) and a tongue portion (12) extending forwardly from the base portion; a contact module (4) having an insulator (42) and a plurality of contacts (41) combined with an insulator; and a card receiving space (10) formed between the insulator and the tongue portion, with contacting portions (411) of the contacts extending into the card receiving space from an upper direction for mating with the conductive traces.

15 Claims, 7 Drawing Sheets

ELECTRICAL CARD CONNECTOR WITH IMPROVED CONTACTS ARRANGEMENT

BACKGROUND OF THE INVENTION

1. Field of the Invention

The present invention relates to an electrical card connector, and more particularly to an electrical card connector with improved contacts arrangement facilitating mating a card.

2. Description of Related Art

TW Pat. NO. M320206 issued on Oct. 1, 2007 discloses a smart card connector, and the small card connector includes an insulative housing, a contact module and a metallic shell. The insulative housing is mounted to a mother board, and the contact module is assembled to the insulative housing and the metallic shell mounted to the insulative housing. There is a card receiving space formed between the metallic shell and the insulative housing to accommodate a corresponding card. The contact module has a plurality of contacts mounted thereon, and each contact has a tail portion soldered to the mother board and a contacting portion extending into the card receiving space. The contacting portions of the contacts are disposed proximate to the mother board. The card has a substrate with a plurality of conductive pads formed on upper side thereof. When the card is inserted into the card receiving space, the card should be reversed firstly to ensure correct mating between the conductive pads and the contacting portions. However, a user often place the upper side of the card upwardly when inserting a card to the card receiving space, and such error operation my damage the card connector.

Hence, an improved electrical card connector is required to overcome the problems of the prior art.

SUMMARY OF THE INVENTION

An object of the present invention is to provide an electrical card connector with improved contacts arrangement so as to facilitate mating with a corresponding card.

Accordingly, to achieve above-mentioned object, an electrical card connector for receiving a card with conductive traces formed on a top side thereof, comprises a first insulative housing having a base portion and a tongue portion extending forwardly from the base portion; a contact module having an insulator and a plurality of contacts combined with an insulator; and a card receiving space formed between the insulator and the tongue portion, with contacting portions of the contacts extending into the card receiving space from an upper direction for mating with the conductive traces.

The detailed features of the present invention will be apparent in the detailed description with appropriate reference to the accompanying drawings.

DETAILED DESCRIPTION OF THE INVENTION

Reference will now be made in detail to the preferred embodiment of the present invention.

Figure 1:
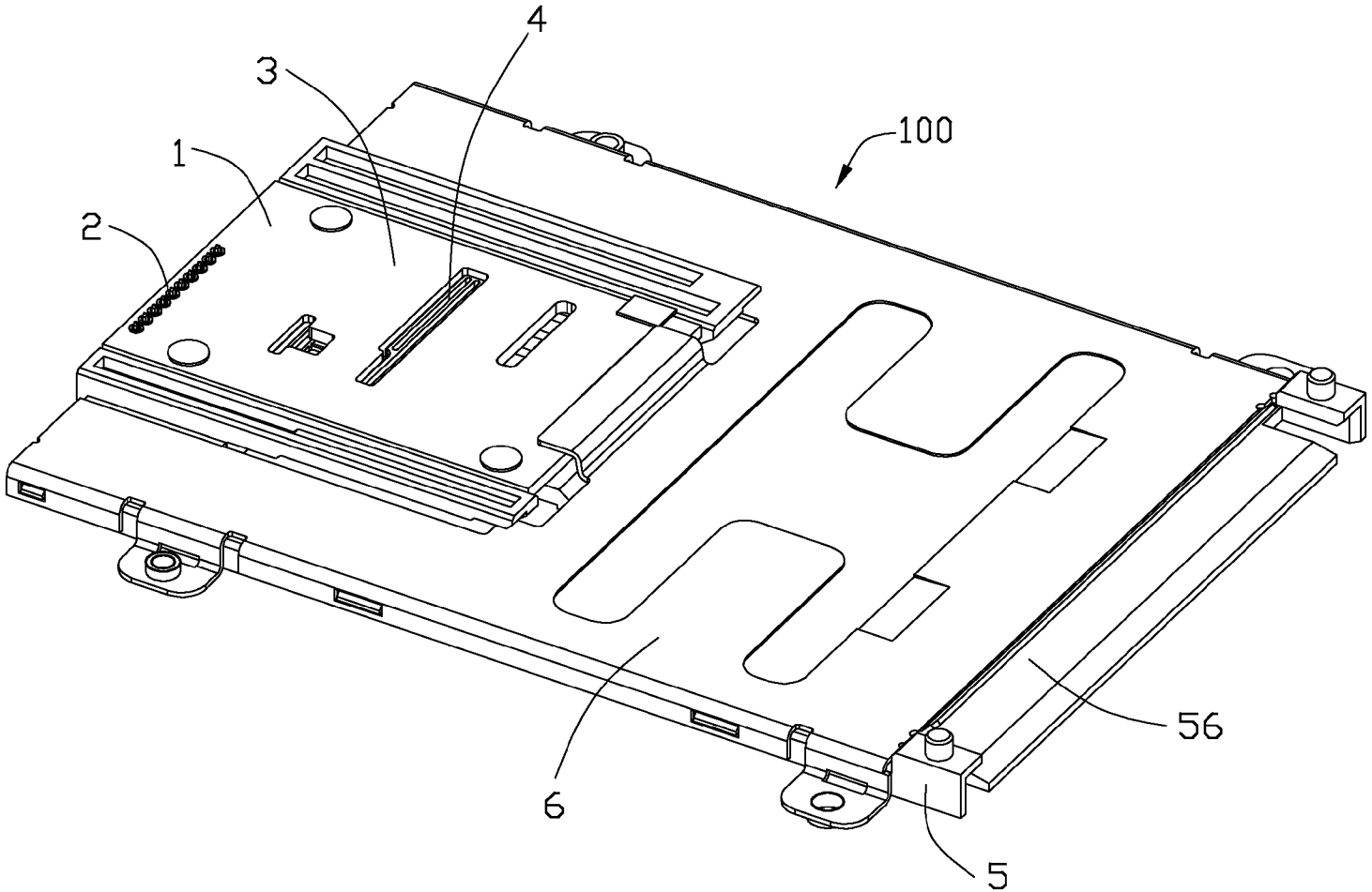
FIG. 1 is a perspective view of an electrical card connector in accordance with the present invention.
Figure 2:
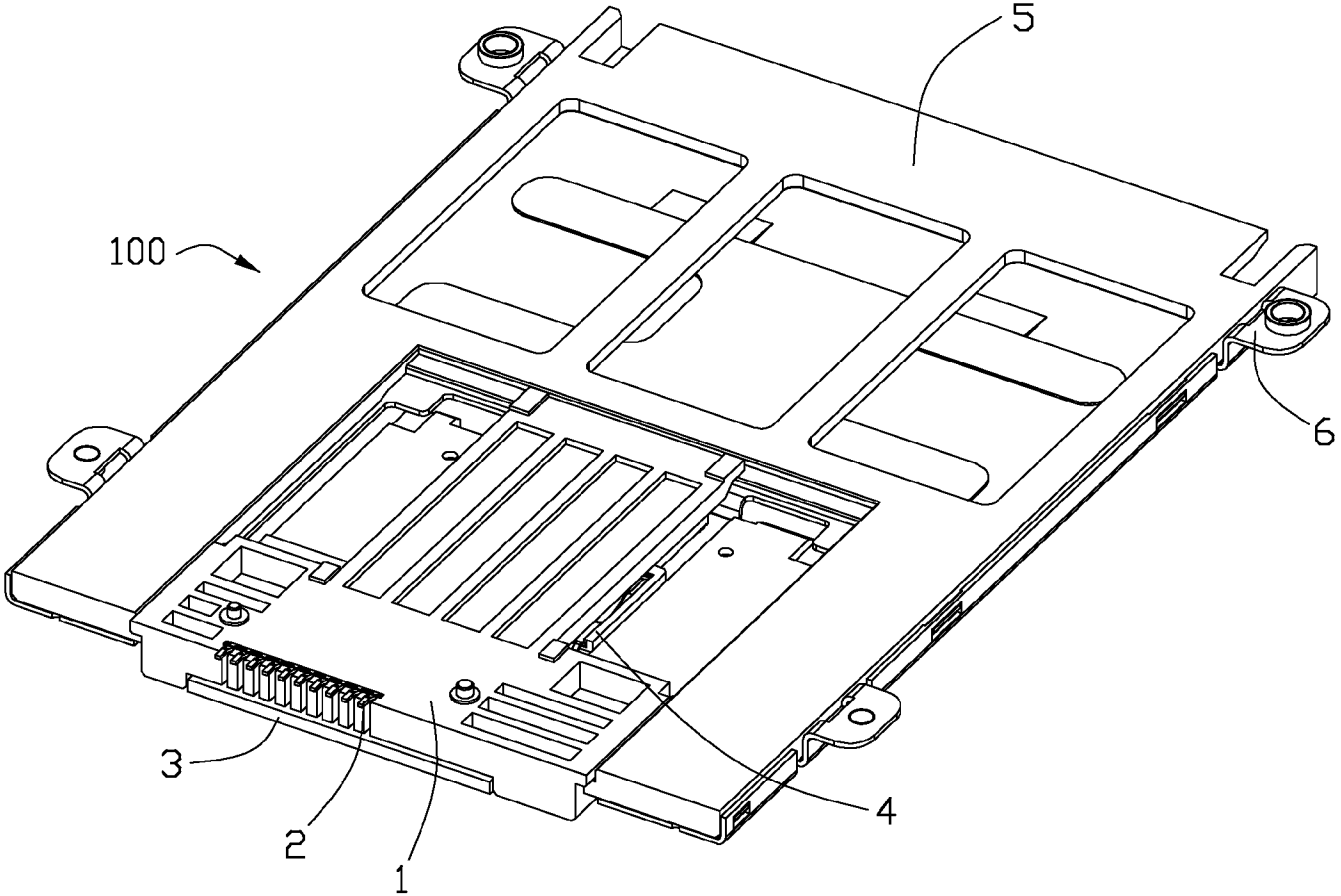
FIG. 2 is similar to FIG. 1, but viewed from other aspect.
Figure 3:
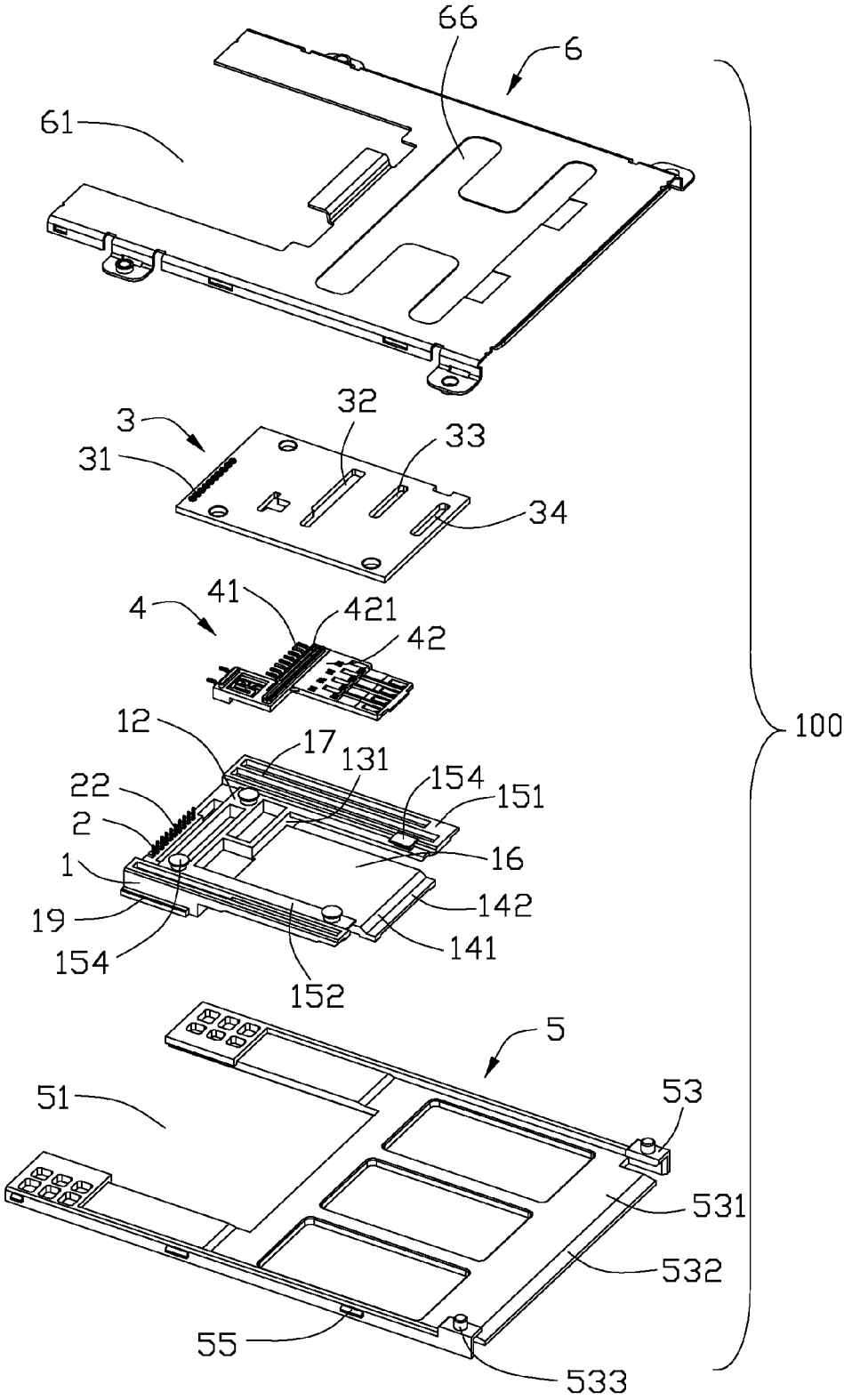
FIG. 3 is an exploded, perspective view of the electrical card connector assembly.
Figure 4:
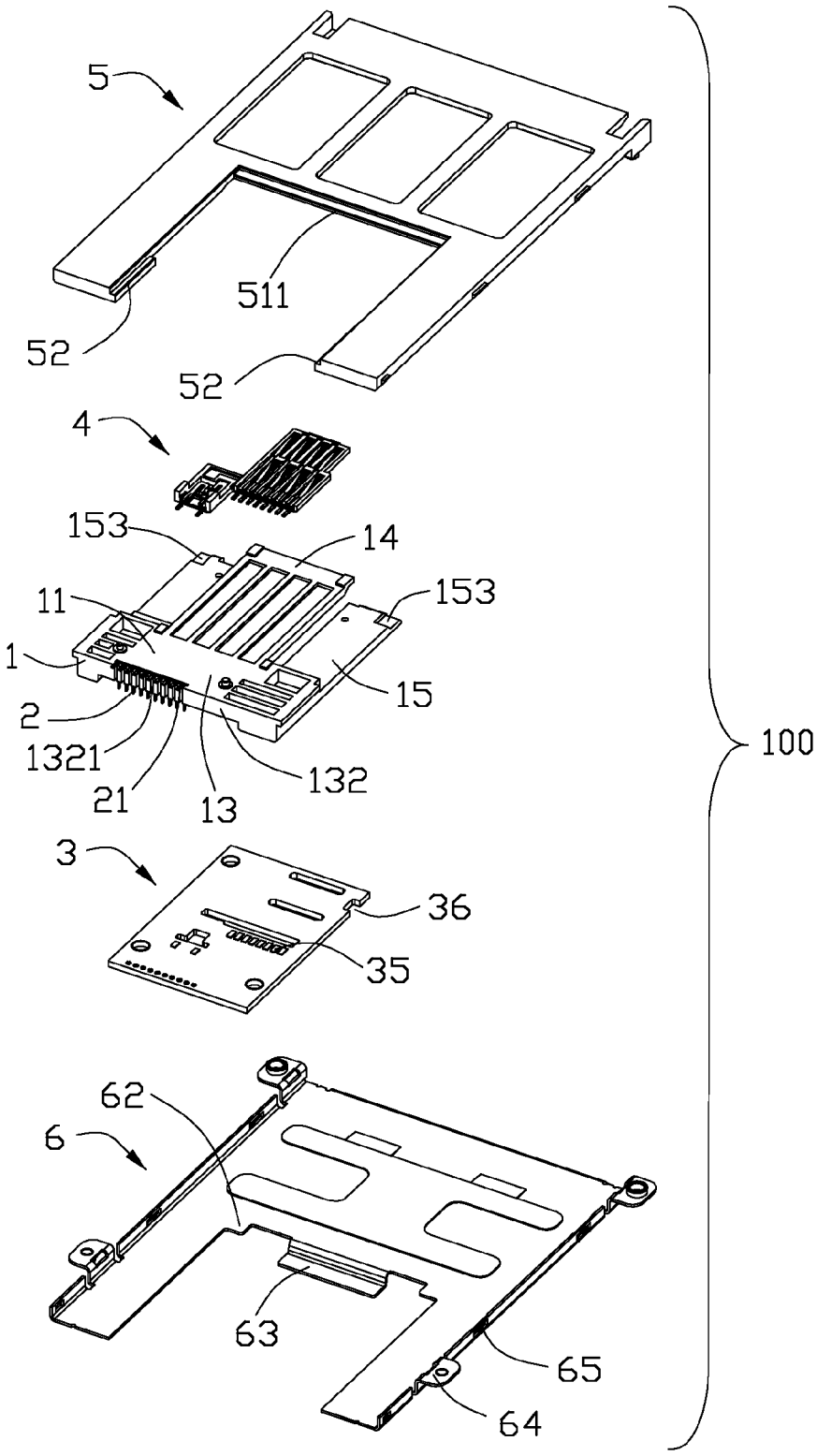
FIG. 4 is similar to FIG. 3, but viewed from other direction.
Figure 5:
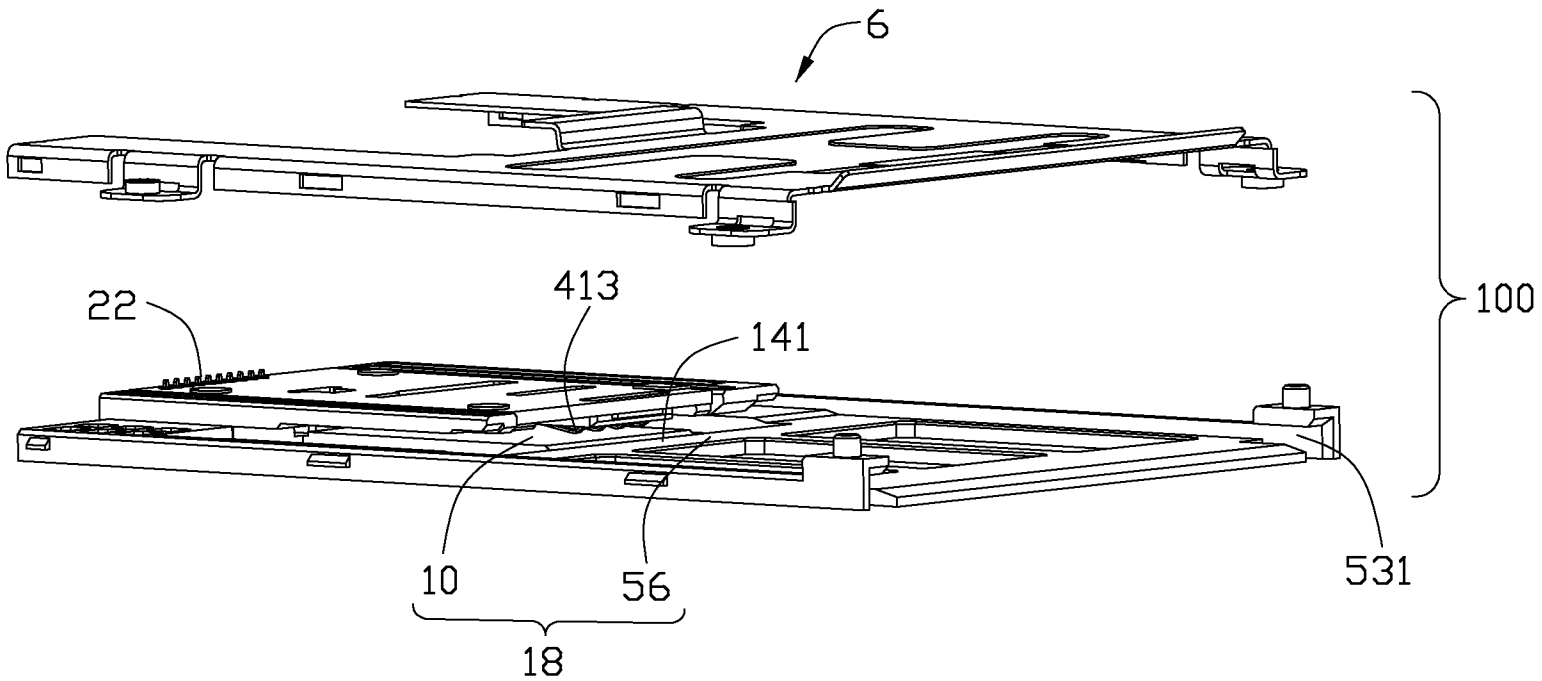
FIG. 5 is a partially exploded, perspective view of the electrical card connector assembly.
Figure 6:
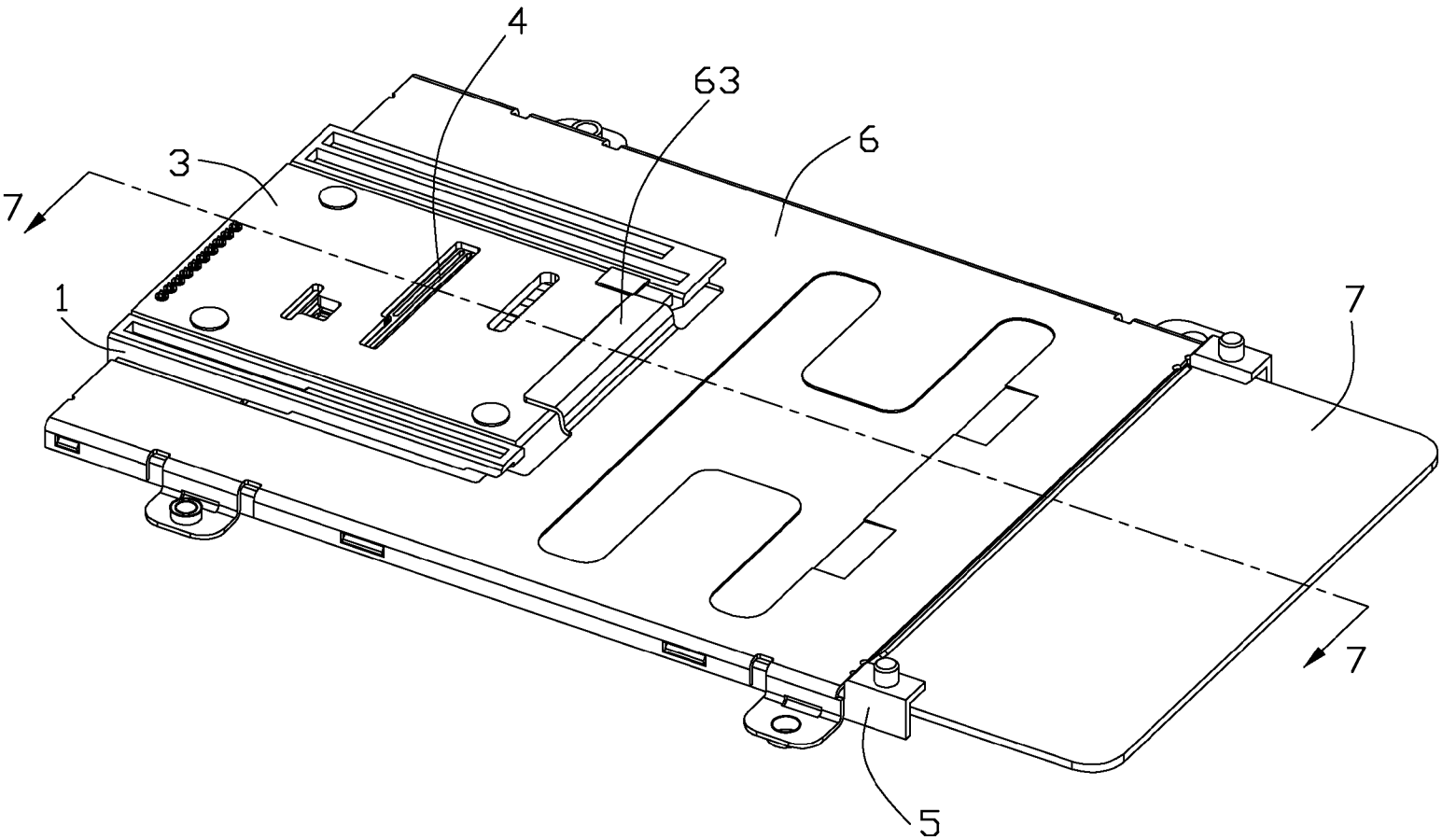
FIG. 6 shows a card inserted into the electrical card assembly.
Figure 7:
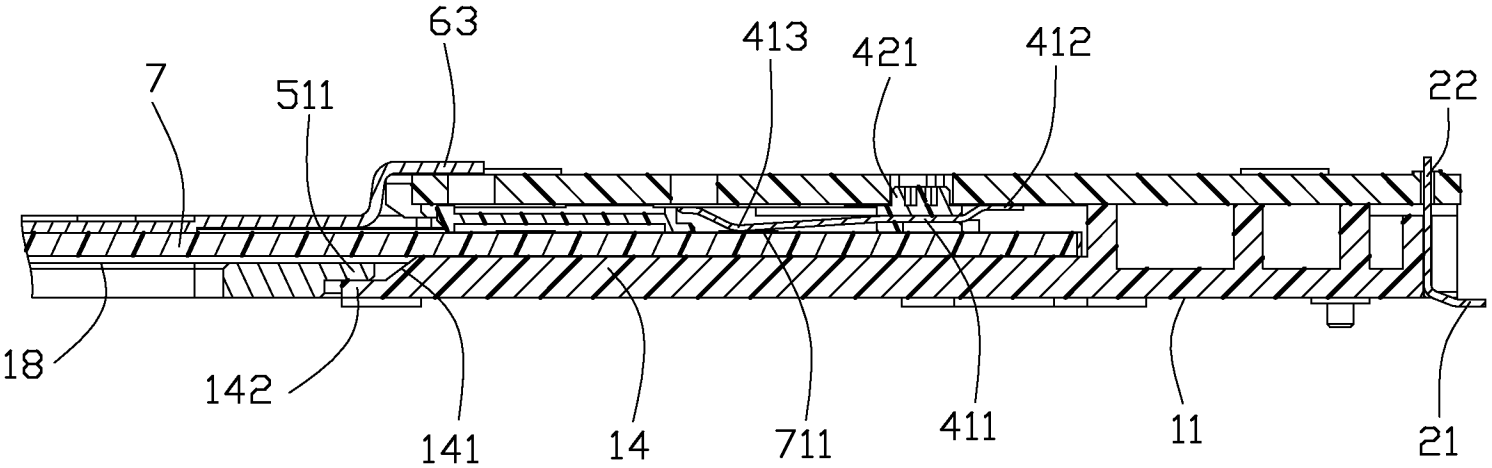
FIG. 7 is a cross-section view of FIG. 6 taken along line 7-7.

Referring to FIGS. 1-7, an electrical card connector 100 in accordance with the present invention is adapted for receiving a card 7 therein. The electrical card connector 100 comprises a first insulative housing 1, a plurality of first contacts 2 mounted to the first insulative housing 1, a printed circuit board 3 assembled to the first insulative housing 1, a contact module 4 mounted to the printed circuit board 3, a second insulative housing 5 engaged with the first insulative housing 1 and a metallic shell 6.

The first insulative housing 1 defines a bottom side 11, a top side 12 opposite to the bottom side 11. The bottom side 11 is located on a mother board (not shown) of a computer. The first insulative housing 1 has a base portion 13, a tongue portion 14 extending forwardly from a front side 131 of the base portion 13 and a pair of mounting arms 15 connected with lateral sides of the base portion 13, with the tongue portion 14 arranged between the pair of mounting arms 15. There are a plurality of vertical contact grooves 1321 defined in a back side 132 of the base portion 13 to receive the first contacts 2, respectively. Each first contact 2 has a first and second soldering foot 21, 22 exposed outwardly of the contact grooves 1321. The first soldering foot 21 backwardly extends along a horizontal direction and the second soldering foot 22 upwardly extends along a vertical direction perpendicular to the horizontal direction. In addition, there is a hollow 16 located between the tongue portion 14 and the two mounting arms 15. The tongue portion 14 defines an inclined leading end 141 and a horizontal free end 142 which is located in front of and disposed adjacent to the inclined leading end 141. The pair of mounting arms 15 includes a first arm 151 and a second arm 152 spaced apart from each other along a transversal direction. There is a cavity 153 located at an outer corner of a bottom side of each mounting arm 15. Furthermore, there are four protrusions 154 formed on inner sides of the first arm 151 and the second arm 152. There are also a number of longitudinal slots 17 defined on the pair of mounting arms 15.

The contact module 4 includes a plurality of second contacts 41 combined with an insulator 42. The printed circuit board 3 is mounted to the top side 12 of the first insulative housing 1, with the contact module 4 disposed therebetween. There are a number of conductive through holes 31 defined in a rear segment of the printed circuit board 3. Also, there are a number of transversal slots 32, 33 and 34 defined in middle and front segments of the printed circuit board 3. The transversal slot 32 engaged with a transversal bar 421 formed on the insulator 42 so as to retain the printed circuit board 3 and the contact module 4 together. The second contacts 41 have retention portions 411 embedded in the insulator 42, tail portions 412 extending backwardly from the retention portions 411 and disposed behind the insulator 42 for soldering to conductive pads 35 which are formed on a bottom side of the printed circuit board 3, and contacting portions 413 extending forwardly from the retention portions 411 and disposed under the insulator 42. The printed circuit board 3 and the contact module 4 are assembled together firstly, with the contact module 4 disposed under the printed circuit board 3, and then the printed circuit board 3 is mounted to the first insulative housing 1, with the protrusion 154 of the first insulative housing 1 engaged with a corresponding hole 36 defined in the printed circuit board 3. The second soldering foots 22 are respectively inserted into and soldered to conductive holes 31 which are located in a back segment of the printed circuit board 3. The contact module 4 is disposed between the first and second arm 151, 152, with the contacting portions 413 extending into the hollow 16. The contacting portions 413 is spaced apart from the tongue portion 14 along an up-to-down direction, to form a card receiving space 10 formed between the insulator 42 of the contact module 4 and the tongue portion 14, with the contacting portions 413 extending into the card receiving space 10 from an upper direction.

The second insulative housing 5 is assembled with the metallic shell 6, with a longitudinal outlet 56 formed therebetween. The outlet 56 is located in front of and communicating with the card receiving space 10 to together form a longitudinal card receiving passage 18 to accommodate the card 7 therein. The second insulative housing 5 defines a first cutout 51 at a back segment thereof and the metallic shell 6 defines a second cutout 61 at a back segment thereof. The first cutout 51 and the second cutout 61 are overlapped with each other. A transversal bar 511 is formed with the second insulative housing 5 and projects into the first cutout 51 from a front side of the first cutout 51. There are two engaging portions 52 formed on the back segment of the second insulative housing 5 and laterally extend into the first cutout 51, respectively. There are two ribs 19 formed at opposite outer sides of the back section of the first insulative housing 1. The rib 19 is engaged with the engaging portion 52. There are two L-shaped guiding portions 53 located at opposite sides of the second insulative housing 5, with an opening 531 disposed therebetween. In addition, there is an inclined leading portion 532 formed at a front segment of the second insulative housing 5, and the leading portion 532 is disposed between the two L-shaped guiding portions 53. There is a post 533 projecting upwardly from a top side of each guiding portion 53. There are two supporting tabs 62 formed at inner corners of the second cutout 61, and the supporting tabs 62 match with the cavity 153 located at an outer corner of the pair of the mounting arms 15. There is a locking tab 63 formed with the metallic shell 6 and disposed between the two supporting tabs 62. Two pairs of mounting ears 64 are formed at opposite sides of the metallic shell 6. There are two positioning holes 55 defined in each lateral section of the second insulative housing 5, and there are corresponding through holes 65 defined in each lateral section of the metallic shell 6. There is a H-shaped protrusion 66 formed on a top side of the metallic shell 6 and extending downwardly therefrom.

When assembling, the contact module 4 is assembled to the printed circuit board 3, and then the printed circuit board 3 and the contact module 4 are together assembled to the first insulative housing 1, and the printed circuit board 3 is disposed between the first arm 151 and a second arm 152. The first insulative housing 1 is mounted to the mother board of a computer. The second insulative housing 5 and the metallic shell 6 together cooperate with the first insulative housing 1, tail portions 412 of the second contacts 41 soldered to the printed circuit board 3. The second insulative housing 5 is joined with the first insulative housing 1, with the tongue portion 14 accommodated in the first cutout 51 and the transversal bar 511 lapping with the a horizontal free end 142 of the tongue portion 142. The printed circuit board 3 is held by the locking tab 63.

The card 7 is a smart card, which defines a top side 71 and a bottom side 72. There are a plurality of conductive traces 711 formed on the top side 71. When the card 7 is inserted into the card receiving passage 18, with the top side 71 facing upwardly to mate with contacting portions 413 of the second contacts 414 directly, i.e., and the card is not need to be upside down, compared with conventional inserting method. The contacting portions 413 of the second contacts 41 are located at an upper side of the hollow 16, and the first contacts 41 are connected to the mother board of a computer by the printed circuit board 3. The design of the current invention facilitates inserting the card 7 into the card connector, while the card 7 is not need to be reversed.

What is claimed is:

1. An electrical card connector for receiving a card with conductive traces formed on a top side thereof, comprising: a first insulative housing having a base portion and a tongue portion extending forwardly from the base portion; a contact module having an insulator and a plurality of contacts combined with an insulator; and a card receiving space formed between the insulator and the tongue portion, with contacting portions of the contacts extending into the card receiving space from an upper direction for mating with the conductive traces, the electrical card connector further comprising a printed circuit board assembled to the first insulative housing, with the contact module arranged therebetween, wherein the printed circuit board defines a transversal slot in a middle section thereof, and there is a transversal bar formed on the insulator of the contact module and engaged within the transversal slot.

2. The electrical card connector as claimed in claim 1, wherein there are a plurality of other contacts mounted to the first insulative housing.

3. The electrical card connector as claimed in claim 2, wherein the contacts mounted to the first insulative housing electrically connected to the contacts of the contact module by the printed circuit board.

4. The electrical card connector as claimed in claim 3, wherein there are a plurality of conductive pads formed on a bottom side of the printed circuit board, and tail portions of the contact module soldered to the conductive pads.

5. The electrical card connector as claimed in claim 4, wherein the contacts mounted to the first insulative housing have first soldering feet disposed under the first insulative housing.

6. The electrical card connector as claimed in claim 5, wherein the first soldering feet extending along a horizontal direction.

7. The electrical card connector as claimed in claim 5, wherein there are a number of conductive through holes defined in a rear segment of the printed circuit board, and the contacts mounted to the first insulative housing having second soldering foots inserted into the conductive through holes, respectively.

8. An electrical card connector, comprising: a first insulative housing having a base portion and a tongue portion extending forwardly from the base portion; a contact module having an insulator and a plurality of contacts combined with an insulator; and the contact module mounted to the base portion and spaced apart from the tongue portion, with contacting portions disposed under the insulator, the electrical card connector further comprising a second insulative housing defining a cutout at a back segment thereof to accommodate the first insulative housing therein, wherein there are two L-shaped guiding portions located at opposite sides of the second insulative housing, with an opening disposed therebetween, wherein there is an inclined leading portion formed at a front segment of the second insulative housing, and the leading portion is disposed between the two L-shaped guiding portions.

9. The electrical card connector as claimed in claim 8, further comprising a metallic shell assembled to the second insulative housing to form a longitudinal outlet therebetween.

10. The electrical card connector as claimed in claim 9, wherein there is a card receiving space formed between the contact module and the tongue portion, and the longitudinal outlet is located in front of the card receiving space.

11. The electrical card connector as claimed in claim 9, further comprising a printed circuit board assembled to the first insulative housing, and there are a number of contacts mounted to the first insulative housing and electrically connected with the contact module via the printed circuit board.

12. An electrical card connector for use with an electronic card, comprising:

an insulative large housing defining, in a front-to-back direction, a front side for card insertion and a rear side with a cutout thereabouts;

a small housing essentially compliantly occupying said cutout;

a small printed circuit board attached to said small housing and essentially located on one side of said large housing in a vertical direction perpendicular to said front-to-back direction;

a terminal module with terminals thereon, mechanically and electrically connected to the small printed circuit board facing toward said small housing, a small space defined between the terminal module and the small housing in said vertical direction;

a set of contacts disposed in said small housing and mechanically and electrically connected to the small printed circuit board for connection to a large printed circuit board on which the large housing is seated; and a cover essentially covering the large housing and located on the same side of the large housing with said small printed circuit board; wherein said cover cooperates with said large housing to define a large space therebetween in the vertical direction under condition that said large space communicates with the small space in the front-to-back direction at a same level so that the electronic card is inserted into the large space and further into the small space for electrical connection with the terminals of the terminal module.

13. The electrical card connector as claimed in claim 12, wherein said small printed circuit board is essentially located, in the vertical direction, away from the large housing than that defined by a main body of the cover.

14. The electrical card connector as claimed in claim 12, wherein the large housing defines a section presses a portion of the small housing in the vertical direction away from the cover.

15. The electrical card connector as claimed in claim 12, wherein the cover defines a section presses a portion of the printed circuit board toward the small housing.

* * * * *